US009694469B2

(12) United States Patent
Okulov

(10) Patent No.: US 9,694,469 B2
(45) Date of Patent: Jul. 4, 2017

(54) PORTABLE MODULAR DEBURRING MACHINE

(71) Applicant: Pavel D. Okulov, Sainte-Anne-de-Bellevue (CA)

(72) Inventor: Pavel D. Okulov, Sainte-Anne-de-Bellevue (CA)

(73) Assignee: IPR Innovative Products Resources Inc., Ste-Anne-de-Bellevue, QC (CA)

( * ) Notice: Subject to any disclaimer, the term of this patent is extended or adjusted under 35 U.S.C. 154(b) by 0 days.

(21) Appl. No.: 14/769,100

(22) PCT Filed: Feb. 21, 2013

(86) PCT No.: PCT/IB2013/051431

§ 371 (c)(1),
(2) Date: Aug. 19, 2015

(87) PCT Pub. No.: WO2014/128528

PCT Pub. Date: Aug. 28, 2014

(65) Prior Publication Data

US 2016/0008946 A1 Jan. 14, 2016

(51) Int. Cl.
*B24B 27/00* (2006.01)
*B24B 27/033* (2006.01)
(Continued)

(52) U.S. Cl.
CPC ..... *B24B 27/033* (2013.01); *B24D 9/04* (2013.01); *B24D 13/10* (2013.01)

(58) Field of Classification Search
CPC ..... B24B 27/033; B24D 9/04; B24D 13/10; A46B 13/00; A46B 13/02; A46B 13/001;
(Continued)

(56) References Cited

U.S. PATENT DOCUMENTS 1,473,582 A * 11/1923 Leedom ..... B23Q 11/0014 144/208.6
2,106,442 A * 1/1938 Stevens ..... B24B 27/0023 134/6

(Continued)

FOREIGN PATENT DOCUMENTS

WO GB 2240736 A * 8/1991 ..... A46B 3/18

*Primary Examiner* — George Nguyen
(74) *Attorney, Agent, or Firm* — Patent Technologies, LLC; Robert D. Gunderman, Jr.

(57) ABSTRACT

An abrasive deburring machine comprised of a plurality of individually controlled abrasive modules, each having a rotatable drum type brush with flexible bristles, the drum is mounted on a rotatable support with axis of rotation generally perpendicular to the rotational axis of the drum. Each support with brush and support drive are mounted inside of a housing therefore creating a module. Plurality of such modules can be combined in a desired configuration to form a deburring machine or finishing/polishing machine tailored to a specific geometry of the work piece or part to be deburred, finished or polished. Each drum and drum support, including its axial angular position are controlled independently, which for a pre-programmed movement of all brushes in order to conform to a complex shape of the part to be deburred, optimize the process of deburring and maximize the durability of abrasive brushes. The drum type brush is preferably made of polystyrene foam with helical groove along its outer shape containing a continuous abrasive filament secured inside the groove and having bristle or strap like abrasive extremities. The invention includes a variety of modes of use being mostly applicable for deburring and finishing operations in Aerospace sector as well as in finishing operations in other metal, plastic and woodworking industries.

15 Claims, 6 Drawing Sheets

(51) Int. Cl.
*B24D 9/04* (2006.01)
*B24D 13/10* (2006.01)

(58) Field of Classification Search
CPC .. B08B 1/00; B08B 1/002; B08B 1/02; B08B 1/04
USPC ..... 451/56, 59, 489
See application file for complete search history.

(56) References Cited

U.S. PATENT DOCUMENTS 2,353,683 A * 7/1944 Martines ..... B24B 3/60 451/231
3,435,479 A * 4/1969 Gibson, Sr. ..... B24B 41/002 15/104.04
3,473,181 A * 10/1969 Leonard ..... B24D 13/10 15/180
3,714,314 A * 1/1973 Davidson ..... B43K 1/12 26/28
3,772,833 A * 11/1973 Belanger ..... B24D 13/06 451/469
3,921,245 A * 11/1975 Clark ..... A46B 13/001 15/179
4,107,807 A * 8/1978 Nash, Jr. ..... B08B 1/04 15/77
4,204,494 A * 5/1980 Bridwell ..... B63B 59/06 114/222
4,448,590 A * 5/1984 Wray ..... B24D 13/04 51/293
4,476,601 A * 10/1984 Oka ..... B08B 1/007 15/77
4,518,452 A * 5/1985 Hundebol ..... B24D 13/04 15/181
4,543,678 A * 10/1985 Cox ..... A01K 5/01 15/21.1
4,599,131 A * 7/1986 Matuszak ..... B08B 9/083 15/60
4,646,473 A * 3/1987 Hundebol ..... B24B 7/00 144/114.1
4,646,479 A * 3/1987 Walker ..... B24B 9/00 451/124
5,125,192 A * 6/1992 Welsch ..... B24D 13/085 451/359
5,129,197 A * 7/1992 Tyler ..... B24D 18/0036 300/21
5,187,904 A * 2/1993 Tyler ..... A46B 3/18 451/463
5,197,998 A * 3/1993 Germain ..... B24D 18/0045 451/533
5,216,847 A * 6/1993 Scheider ..... B24D 13/10 451/463
5,355,639 A * 10/1994 Ferard ..... B24B 7/30 451/28
5,643,068 A * 7/1997 Ward, Sr. ..... B24D 11/008 451/399
5,858,112 A * 1/1999 Yonemizu ..... B08B 1/007 134/32
5,865,668 A * 2/1999 Stewart ..... B24B 9/20 451/28
5,903,951 A * 5/1999 Ionta ..... A46B 3/005 15/180
5,940,918 A * 8/1999 Binette ..... A63B 57/60 15/104.92
5,996,167 A * 12/1999 Close ..... B24D 3/28 15/230.12
6,015,334 A * 1/2000 Hundeb.o slashed.l ..... B24B 41/047 451/28
2007/0034232 A1* 2/2007 Diotte ..... B08B 1/04 134/6
2007/0042685 A1* 2/2007 Jakobuss ..... B23D 51/025 451/41
2008/0189923 A1* 8/2008 Hundebol ..... B24D 13/10 29/81.05
2008/0280541 A1* 11/2008 Chou ..... A46B 13/003 451/59
2010/0285727 A1* 11/2010 Chang ..... B24D 13/10 451/166
2014/0242892 A1* 8/2014 Okulov ..... B24D 13/04 451/496
2014/0349553 A1* 11/2014 Kim ..... A63B 47/00 451/50
2016/0008946 A1* 1/2016 Okulov ..... B24B 27/033 451/56

* cited by examiner

PORTABLE MODULAR DEBURRING MACHINE

TECHNICAL FIELD

The invention generally relates to abrasive finishing and deburring tools, machinery and methods thereof.

BACKGROUND ART

Abrasive tools utilizing flapping tapes or straps extending radially from the rotating hub are well known from the prior art. One of those devices known as 'Fladder' is utilizing rotating tools composed of layers of ring-shaped abrasive wheels (U.S. Pat. No. 4,518,452) with abrasive straps extending outwards radially and forming a cylindrical brush-like tool (U.S. Pat. No. 4,637,173). Plurality of such rotary tools can be used simultaneously (U.S. Pat. No. 6,015,334) to achieve high efficiency and uniformity of material removal and at the same time provide for a simple method of accessing of edges of pockets, holes, walls and other geometrical features of structural parts. This type of a tool is specifically desired in aerospace manufacturing process and is proved to be efficient. Deficiency of such tools remains the limited geometries of parts it can handle, inability to conform to the variety of heights of the part features with one setup and high overall cost of the machinery.

There are a variety of abrasive brushes with bristle like abrasive extremities. For instance in the US application #2008/0189923 assigned to 3M an abrasive filament includes abrasive particles imbedded into a polymeric matrix which can be moulded; the US application #2008/0189923 by Hundebol is utilizing wires and rollers to hammer the surface and provide cleaning by impact effect the U.S. Pat. No. 5,903,951 assigned to Minnesota Mining and Manufacturing Company where abrasive bristles are moulded; the U.S. Pat. Nos. 5,643,068 and 5,197,998 assigned to Minnesota Mining and Manufacturing Company and finally the U.S. Pat. No. 5,125,192 assigned to Dynabrade, Inc. teaches tools where abrasive filaments ate provided as a stack of flat abrasive sheets of variety of shapes with slits separating it into strap-like members.

One of the more common abrasive finishing wheels known from prior art is a flap wheel. Typically such flap wheels are formed by a radial array of sheets of paper or rayon cloth with a layer of abrasive grits such as aluminum oxide resin bonded to one side thereof. Such tools are useful for contoured polishing and blending of ferrous and non-ferrous metals, plastic and wood. However, such tools can only be run in one direction. The layer of abrasive adhered to one side of the cloth tends to wear the cloth or paper of the adjacent flap.

Limitations of such tools remain is their high cost, dictated labour intensive manual manufacturing processes.

There is a rotary tool by Okulov assigned to Dburr Technologies Inc. utilizing folded abrasive filament continuously wound into a helical groove pre-cut by hot knife in the polystyrene drum (PCT/CA2012/000719). This tool is cost effective and allows for a variety of applications, particularly ones commercially available from Fladder Company and utilizing machinery generally described in U.S. Pat. No. 6,015,334

Another disadvantage of Fladder type and similar other machines is their high cost which is prohibitive for small machine shops. The machinery itself has a reduced flexibility of it configurations and generally limits the width of the part to be deburred to 1.8-2 m. However, many commercial aircrafts require deburring operations on parts substantially wider and having complex shape with multiple pockets, edges and holes positioned at different height of the piece. Thus the need for a machine allowing deburring operations on such complex shapes and for larger widths exists, Neither of the above reference available from prior art teaches an arrangement where the deburring machine will have modular structure allowing for tailoring of the machine for exact manufacturing needs.

DISCLOSURE OF INVENTION

Technical Problem

The objective of this invention is to provide a cost effective automated modular abrasive machine suitable for deburring or finishing operations in aerospace manufacturing and utilizing abrasive brushes. It is one of the major objectives to provide a method of forming of a deburring station-machine from individually controlled deburring modules, in essence providing a novel approach in deburring machinery and providing CNC capabilities for deburring operations. Another general objective of present invention is to create technology allowing for reduction of labour intensive operations in variety of industries and therefore enhance manufacturing efficiency and reduce associated costs.

SOLUTION TO PROBLEM

Technical Solution

The preferred embodiment includes hexagonal shape housing with rotatable brush drum, preferably made from polymeric foam having to helical groove with inverted V-shape of the cross section on its outer surface and with abrasive filament inserted by its edge into it and secured thereof. The abrasive filament is prepared from a precursor abrasive tape or sheet's (rejoined, if needed to form a continuous tape) by cutting a pattern having extremities or straps integral formed from said precursor and folding it in such way that it buckles inside said V-groove.

Said drum is rotatably mounted on a fork-like support which in turn is mounted on an axle generally parallel to the axis of symmetry of said hexagonal housing and having at least one freedom of movement, namely rotational. For the purpose of controlling the depth of reach of deburring tool said axle can be also moveable in axial direction. Controlling of the rotational direction and speed of the drum, fork-like support and its axle can be numerically controlled and can be independent from each other.

It is important to note that the shape of the housing can be any, the essential part is that each module having its own housing can be part of the overall structure of the deburring station, thus the preferred hexagonal shape should not be perceived as limiting the scope of this invention.

Accordingly, in addition to hexagonal, the shape of the housing in its cross section can be round (forming cylindrical shape), square (parallelogram shape), triangle, etc.

Connecting of the modules in the structure of the deburring machine or station of a desired shape can be done by fixing it together side by side by bolts or other means suitable for it. In case of a hexagonal shape of the housing a structure resembling honeycomb can be achieved where the areas of deburring covered by individual brushes will generally overlap to avoid gaps in deburring processing of parts while being passed by the brushes during deburring.

It has to be understood, that the feed of the part to be deburred or processed (sanding, polishing, etc.) can be done either manually, or utilizing appropriate conveyor's means or by movement of the deburring module or structure against the stationary part. In the latter case, a robotic arm, for instance, can be used or rails, cranes, etc.

The abrasive brush of present invention can be either disposable or reusable as the drum and groove are not wearing during the tool operation and a new filament can be used to refurbish the brush. The brush can be manufactured at the fraction of the cost present systems like 'Fladder' offers and therefore can encourage use of this simple yet effective deburring method and increase its acceptance of it by aerospace industry reducing the overall costs of production of aluminum and titanium parts. It can also promote its use in deburring and finishing operations in general metal working and wood/plastic working industries.

Another variant of present invention is a hand-held abrasive tool (for instance cordless, employing electric drivels utilizing rechargeable battery, or utilizing pneumatic or electric energy). In this mode the present invention can have appropriate and ergonomic handles and also may employ a simplified drive, simultaneously providing for rotation of the brush and rotation of the brush support.

To the accomplishment of the foregoing and related ends the invention, then, comprises the features hereinafter fully described and particularly pointed out in the claims, the following description and the annexed drawings setting forth in detail certain illustrative embodiments of the invention, these being indicative, however, of but a few of the various ways in which the principles of the invention may be employed.

ADVANTAGEOUS EFFECTS OF INVENTION

Advantageous Effects

The invention provides a universal modular deburring machine or station, which can be configured to fulfill deburring or finishing operations on parts of any size and shape. The cost of the machine is significantly less of those of similar application and presently available, which makes this invention affordable and equally attractive to small and large machine shops in variety of industries, such as metalworking or woodworking industry and alike. Another advantageous effect is the capability of machine to work in a fully programmable mode similar to CNC machinery, which provides for a higher efficiency of operations in labour intensive sector related to deburring and finishing operations.

BRIEF DESCRIPTION OF DRAWINGS

Description of Drawings

Figure 1:
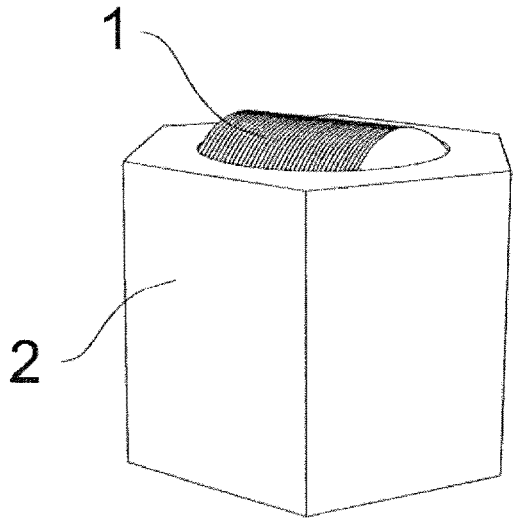
Figure 2:
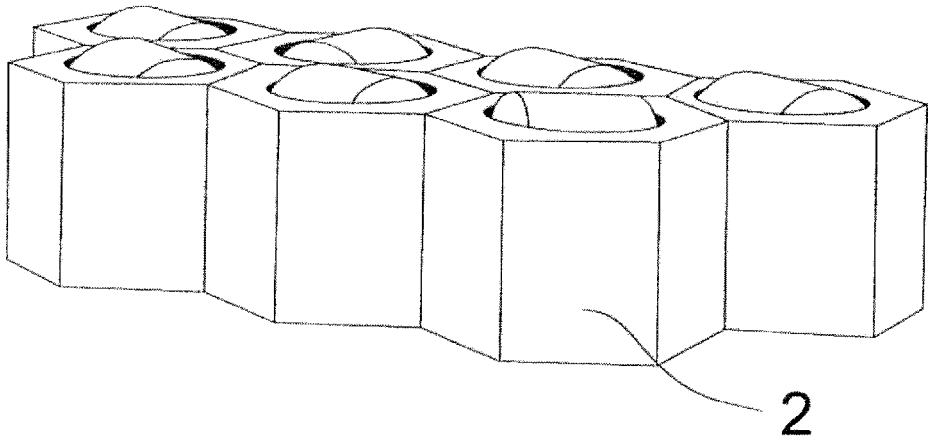
Figure 3:
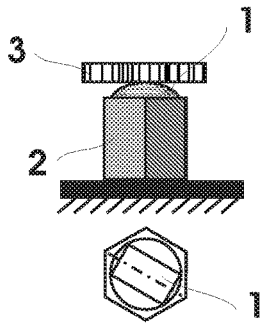
Figure 4:
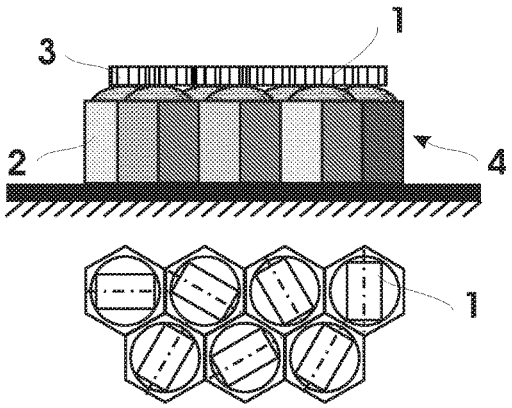
Figure 5:
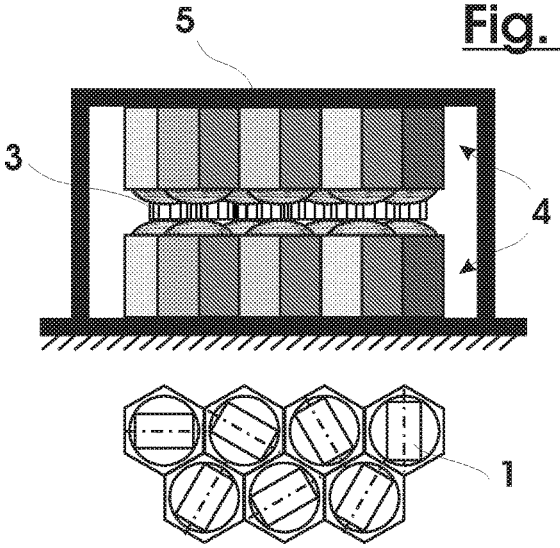
Figure 6:
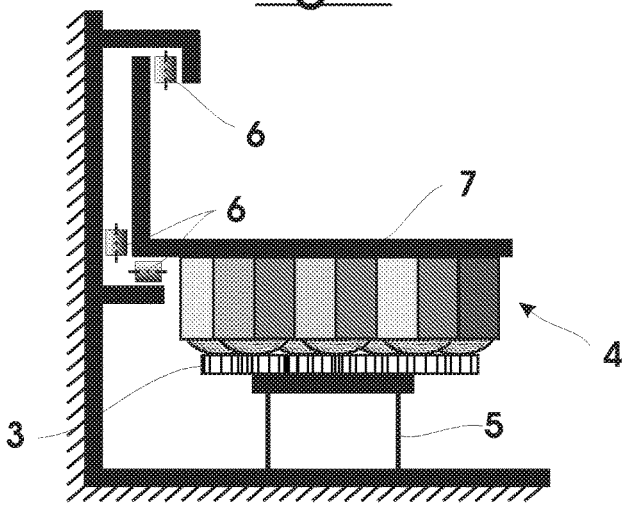
Figure 7:
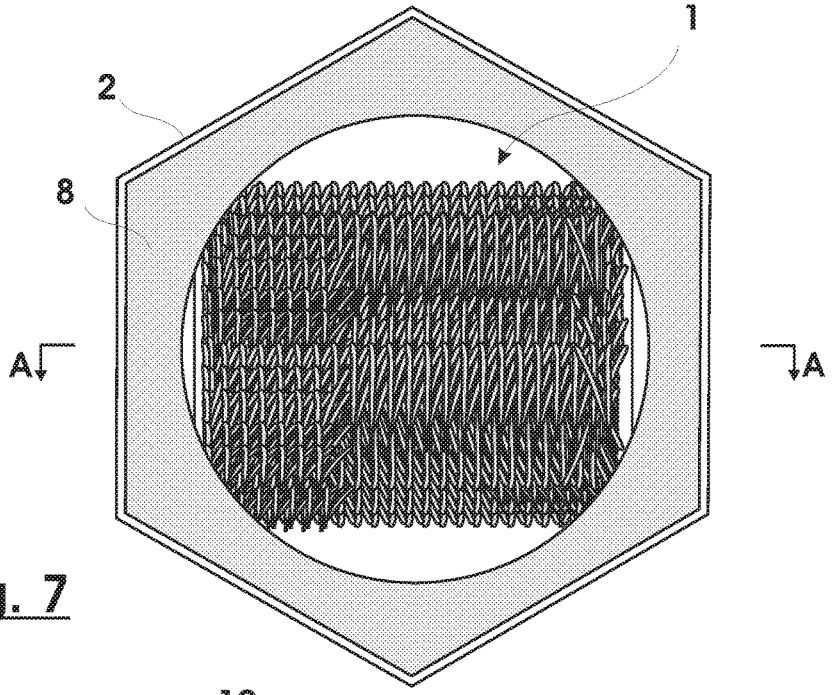
Figure 8:
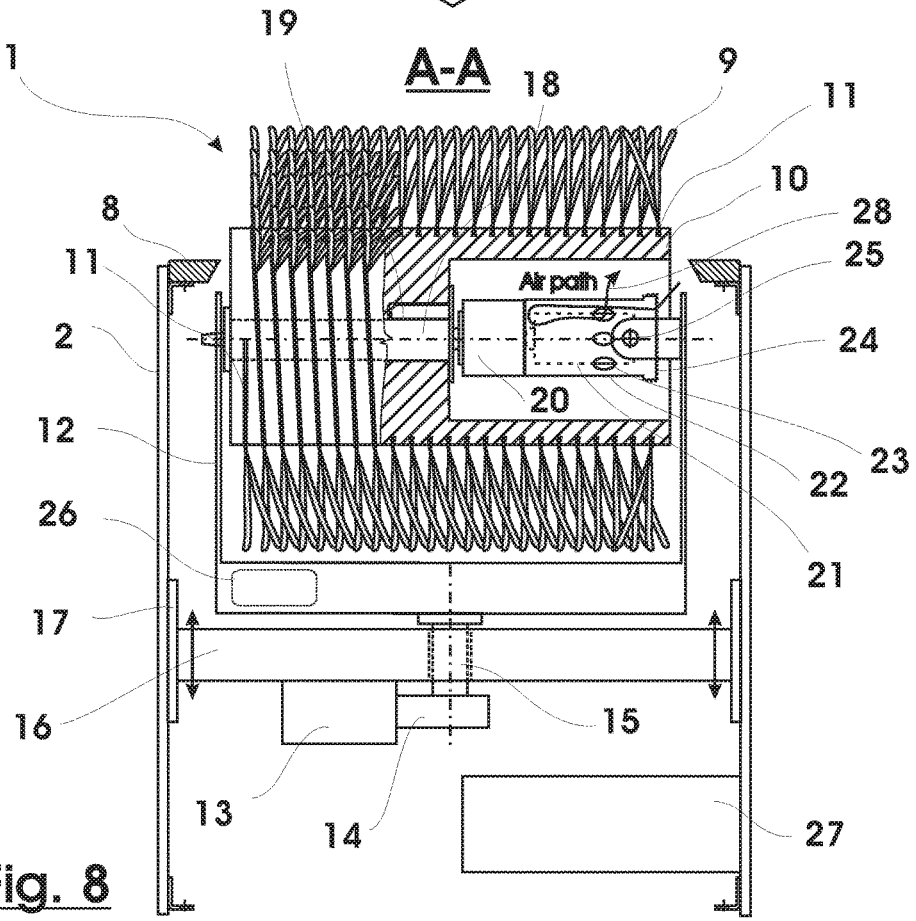
Figure 9:
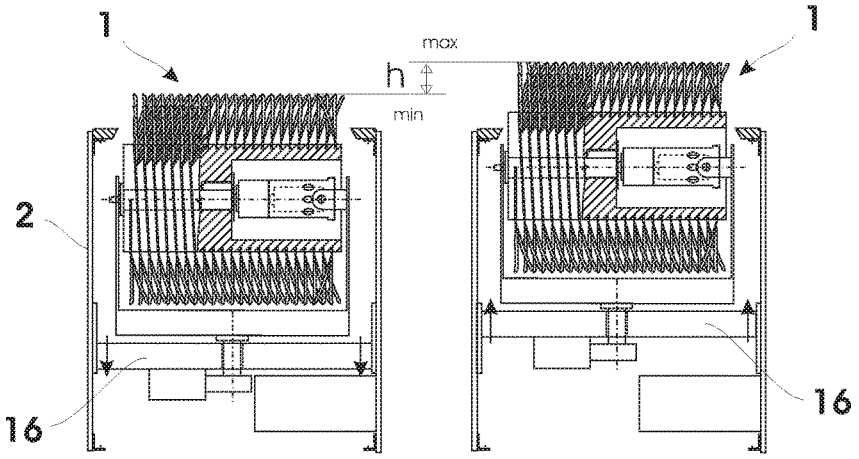
Figure 10:
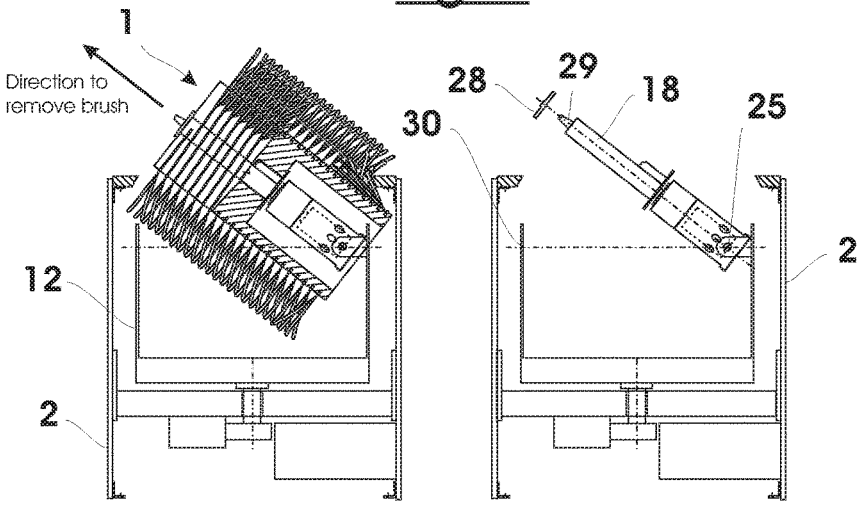
Figure 11:
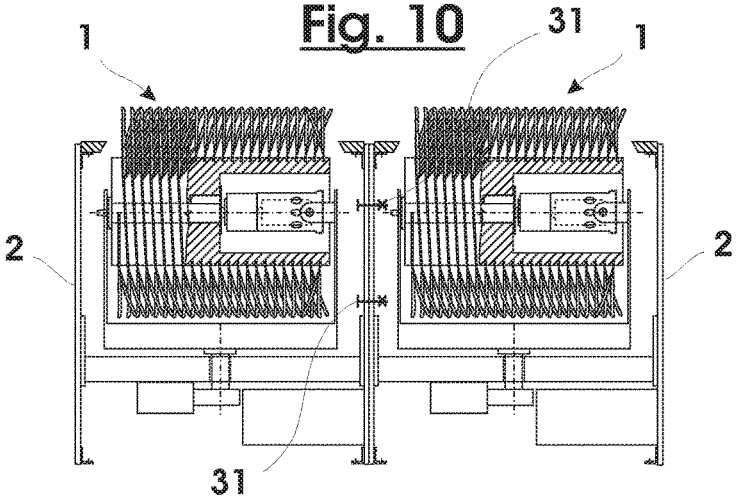
Figure 12:
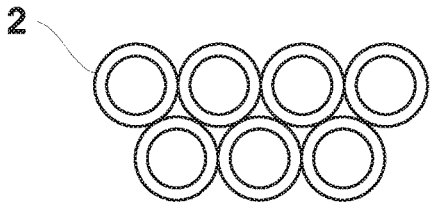
Figure 13:
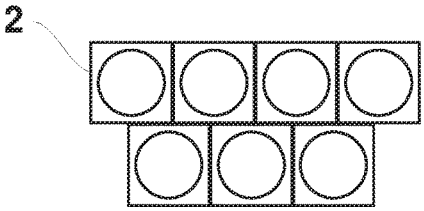
Figure 14:
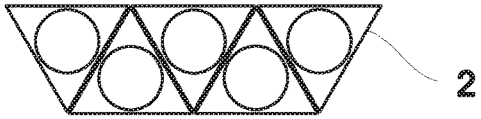
Figure 15:
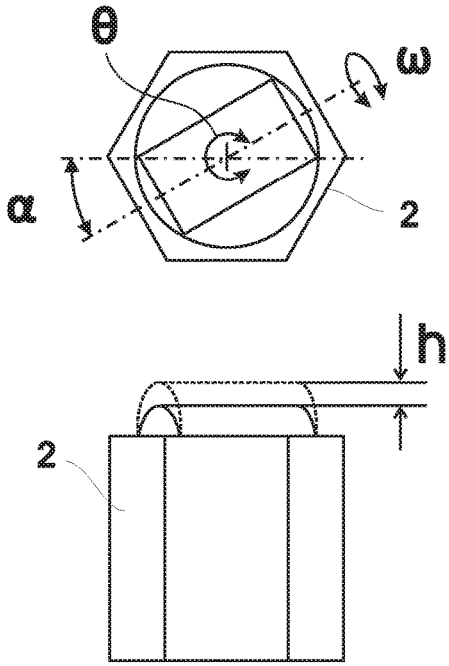
Figure 16:
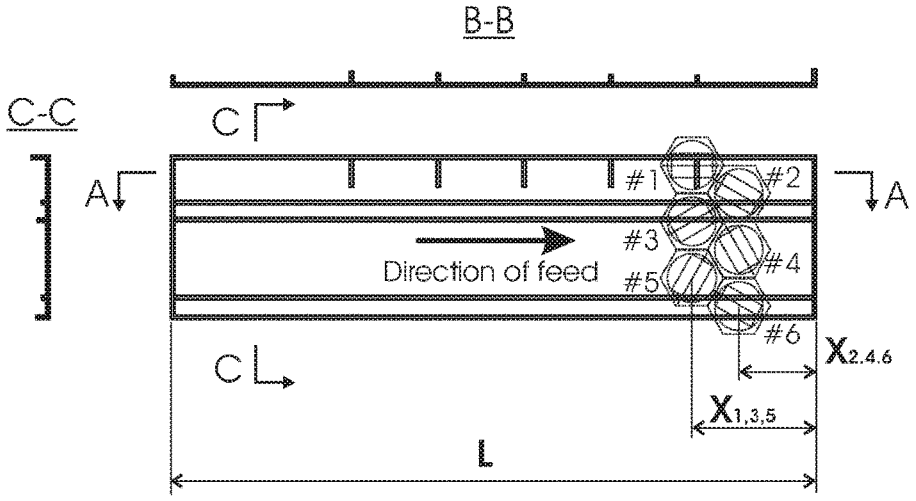

FIG. 1 is a general view of the deburring module with a housing or hexagonal shape suitable to be positioned on a bench or integrated into a shop equipment;

FIG. 2 is a general view of the deburring station comprised of several modules and providing for a honeycomb structure;

FIG. 3 is a general view of the variant of the deburring station comprising of a single module of hexagonal shape;

FIG. 4 is as general view of the variant of the deburring station comprising of several modules of hexagonal shape resembling a honeycomb structure;

FIG. 5 is a general view of the variant of the deburring station resembling 'sandwich'-like structure and allowing for simultaneous deburring of parts from both sides by utilizing two honeycomb structures facing each other;

FIG. 6 is as general view of the variant of the deburring station with moveable support integrated into a shop;

FIG. 7 presents top view of the deburring module with hexagon shape housing;

FIG. 8 shows an elevation of the deburring module;

FIG. 9 explains the mode of operation with controllable vertical position of the deburring brush;

FIG. 10 illustrates method for replacement of deburring brushes;

FIG. 11 shows two identical modules bolted together to create a structure;

FIG. 12 illustrates a deburring structure composed of individual modules of cylindrical shape attached to each other;

FIG. 13 illustrates a deburring structure composed of individual modules of rectangular shape attached to each other;

FIG. 14 illustrates as deburring structure composed of individual modules of triangular shape attached to each other;

FIG. 15 provides an illustration for general parameters of operation of a single deburring module, such as direction and speed of rotation of the brush, angular position of the brush and height of vertical position of the brush;

FIG. 16 is illustrating a sample pattern of a part to be deburred, and

Figure 17:
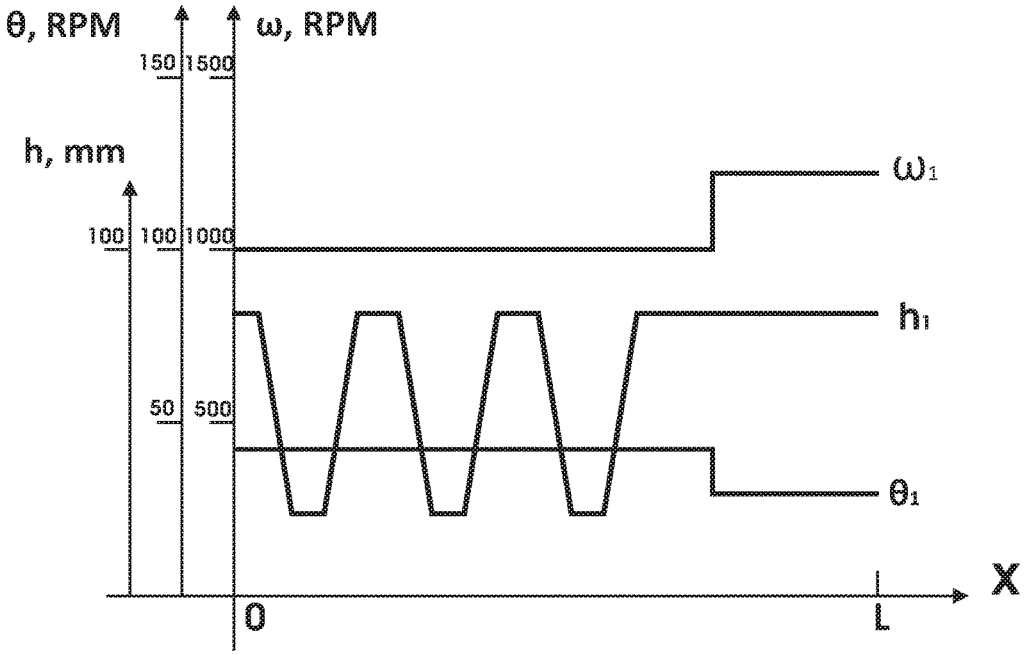

FIG. 17 shows a variant of the associated algorithm of operation of individual deburring modules allowing for efficient deburring.

BEST MODE FOR CARRYING OUT THE INVENTION

Best Mode

Best mode of the invention is generally illustrated by FIG. 8. The module of the best mode is capable of being used as 'building block' for a deburring machine of any configuration and providing for fully programmable automated operation.

MODE FOR THE INVENTION

Mode for Invention

Referring first to FIG. 1 there is illustrated a single module of a hexagon shape with rotating brush 1 and housing 2 presenting a portable bench top deburring or polishing station.

FIG. 2 illustrates a honeycomb structure assembled from single modules by connecting its housings 2 together and capable of simultaneous and individually controlled working of all brushes on parts of complex shape and significant size. With the site of hexagon housing (between flats) of 500 mm, the seven modules' station like shown in FIG. 2 can handle parts of up to 1800 mm wide and of any length.

FIG. 3 illustrates in close detail a single module of hexagonal shape with rotating brush 1 deburring part 3.

A deburring station consisting of several individual modules creating honeycomb structure 4 is illustrated in FIG. 4. Here, each brush 1 can have an independent control over its rotational speed '$\omega$', angular position '$\alpha$' (relative to its housing), rotational speed '$\theta$' of the fork supporting the brush 1 and the height 'h' of the protrusion of the brush in vertical direction (bringing it closer to or farther from the work piece part 1)—the parameters illustrated in greater detail below in FIG. 15.

Going back to the next illustration, FIG. 5 shows two honeycomb assemblies 4 supported by frame 5 and providing for simultaneous deburring of a work piece 1 from both sides, thus increasing efficiency of deburring operations. Each structure 4 and each deburring module can have pre-programmed operating parameters or individual settings depending on part's 3 features and geometry, as well as the speed of feeding of the part 3.

Referring now to FIG. 6, the whole structure 4 can be moveable against the part 3. In this particular instance, a console 7 with rollers 6 can move along the wall or length of a machine shop thus providing for deburring or finishing operations of a very long part without occupying much of the floor space. The part 3 support 5 can be of any type.

FIG. 7 illustrates a top view of the hexagonal shape module including brush 1, housing 2 and a support surface 8 within. This support surface 8 is used to provide a steady support during manual deburring operations; structurally it provides necessary stiffness for the housing 2 as well, which is important for the overall integrity of a system 4 comprised of several modules.

An elevation A-A further describing principle of operation of the deburring machine is provided in the FIG. 8. The abrasive brush in this particular example consists of a drum 10 with helical groove 11 provided on its outer surface and continuous filament of abrasive with multiple straps 9 secured in the groove 11. The drum 10 is supported by driving shaft 18 and is secured against rotation (relative to the shaft 18) by a slot and a corresponding plate 19, connected to the shaft 18. The shaft 18 is further connected to the output of the gearbox 20 driven by motor 21 (for instance electric motor). The motor 21 has housing 22 with ventilation openings 23 for exhaust of cooling air circulating in air path 28. The intake of the air is done through replaceable filter 24 covering housing 22, then the air is passed through the interior of the motor 21 where it cools it down and is driven outside of the housing 22 through the openings 23. The openings 23 can have additional filtering means to prevent abrasive debris and foreign particles from entering the interior of the housing 22 while the motor 21 in not operating and there is no air flow otherwise pushing out the debris. The motor 21 would typically have a centrifugal fan for the circulation of cooling air and adequate openings part of its own design.

The brush 1 is supported by a fork-like support 12 with hinged joint 25 allowing for pivoting movement of the assembly of driving shaft 18, gearbox 20 and motor housing 22 during brush replacement or service.

The fork-like support 12 can have an additional counter weight 26 to balance the whole assembly during its rotation along axle 15. The driving means for the support 12 contain motor 13 with gearbox 14 (preferably worm gear type or traction type). The beam 16 can be moveable in vertical direction as shown by arrows and the drive for vertical adjustment of the beam 16 can be electric, hydraulic or any other type. In a simplest configuration the beam 16 vertical position can be fixed or made adjustable, for instance by fixing it against guiding rails 17 by bolts or clamps.

The deburring module can be self contained and include its own source of power (rechargeable battery, for instance) or a power supply 27. Controls of all parameters of operation can be done remotely via electronic interface (not shown), for that purpose each drive can have positioning and speed sensors or other feedback means. Each module can also have simple controls as well as more sophisticate electronic control module providing for its operation, programmation and/or interface with computer or the cluster (net) of other deburring modules.

As it was mentioned, the drives can utilize motors of any suitable type. Alternatively, a single motor can provide for a drive (through geared transmission, for instance) for both, the brush 1 and its support 12.

The effect of adjustment of vertical position of the brush 1 is illustrated in FIG. 9. Here, the minimum and maximum height of brush position is duly denoted.

Brush's replacement technique is further illustrated in FIG. 10. For replacement, the shaft 18 is freed from its engagement with fork 12 by bending of the vertical leg of support 12, then the locking nut (not shown) of pivoting joint 25 is released and the shaft 18 with brush 1 is moved in swinging motion providing access to the tightening nut 28 and allowing brush 1 replacement. This procedure allows for quick replacement of the brush or provides for better access to the interior of the housing 2. Alternatively, access to the interior of the housing 2 can be achieved through the bottom of the housing, which can be kept open. Other variants of the release mechanism can be readily employed.

It should be noted that the particles and debris formed during deburring operation evacuation is utilized for this invention, but the details of the evacuation technique are not part of the present description. It can be provided for by any conventional method like utilizing vacuum evacuation, vortex evacuation and collectors of dust techniques, filters, etc. A single module bench top machine can be also positioned directly on a standard deburring table and evacuation of particles can be therefore achieved in a conventional way through the open bottom of the housing 2.

Connecting of the individual modules 2 into a structure can be, for instance, provided by utilizing bolts 31, as shown in the FIG. 11. It has to be understood that the modules 2 can be interconnected in any fashion and can comprise for a geometry of any choice, i.e. the housings 2 can be parallel or positioned at desired angle using spacers (not shown), their relative position can be aligned or provided in a 'step' fashion, etc.

Variety of 'honeycomb' type configurations are shown in the FIGS. 12-14. Certain overlapping of the zones of abrasive action of individual rotating brushes is desired, thus a 'honeycomb' interconnection is generally advantageous. It has to be understood that building of the desired structure resulted from interconnection of the individual modules is similar to using building blocks and the resulting shapes and geometries are endless. To that extend, some space can be simply left unoccupied where parts' or work piece's shapes or their specific zones do not require deburring.

Controlling of an individual module includes controlling of rotational speed and direction of rotation of the brush '$\omega$' (more precisely '$+/-\omega$' where the sign '+' or '−' denotes the rotational direction while the value of rotational speed is denoted by '$\omega$'); accordingly, the rotational speed and direction of rotation '$\theta$' of the brush support; angular position '$\alpha$' of the brush at any given moment of time during its rotation or while being stationary), and the height 'h' of protrusion of the brush towards the work piece 3—all illustrated in the FIG. 15.

Controlling of the above parameters can be done using electronic controls with feedback, pre-programmable or numerically controlled methods and devices appropriate for the art. In essence, the present invention presents a numerically controlled deburring station of a flexible layout, which, as mentioned previously, can be extremely advantageous for a variety of industries and more specifically for the aerospace industry.

A practical example of an elongated part being deburred by a cluster of six modules numbered is #1, #2, #3, #4, #5 and #6 is shown in the FIG. 16. Accounting for the direction of part feeding indicated by an arrow, the groups of modules #1, #3, #5 and #2, #4 and #6 have different horizontal position relative to the part 3 and being denoted as $X_{1,3,5}$ and $X_{2,4,6}$. Variety of geometrical features of a part, including, but not limited to ribs, holes, pockets, etc. require optimum deburring utilizing different parameters ω, θ, α and h. Thus, the individual programming of brushes operation is desired to prolong brushes' life and optimize the overall process.

FIG. 17 provides an insight to the algorithm and methodology of the programmation of the operational parameters related to the individual module #1 and is shown in the diagram in relation to the relative position $X_1$ of the module #1 relative to the length 'L' of part 3. This diagram should be treated as an illustration only and it is not intended to display an actual algorithm of the optimized process, which will be part of another inventive claim.

Although the invention has been shown and described with respect to certain preferred embodiments, it is obvious that equivalent alterations and modifications will occur to others skilled in the art upon the reading and understanding of this specification. The present invention includes all such equivalent alterations and modifications, and is limited only by the scope of the following claims.

INDUSTRIAL APPLICABILITY

The machine per present invention has highest applicability in Aerospace manufacturing industry for deburring operations of Aluminum and Titanium parts.

SEQUENCE LISTING FREE TEXT

Sequence List Text

What is claimed is:

1. An abrasive machine suitable fling operations comprising a rotatable hub having an axial axis extending between a first end and a second end and an abrasive filament formed and secured against said rotatable hub and said rotatable hub mounted on a support, a rotating means for rotating said rotatable hub in a predetermined direction about a hub rotation axis that is coincident with said axial axis of said rotatable hub and supprt rotating means for rotation of said support in a predetermined direction about a support, rotation axis, wherein said hub rotation axis is perpendicular to and coplanar with said support rotation axis and wherein said support rotation axis crosses said hub rotation axis at a point along said axial axis of said rotatable hub at a position between said first end and said second end of said rotatable hub.

2. The abrasive machine as set forth in alaim 1 wherein said hub is made of polymeric foam.

3. The abrasive machine as set forth in claim 1 wherein said abrasive filament is flexible fabric or fiber backed abrasive providing for bristle like abrasive extremities or flaps.

4. The abrasive machine as forth in claim 1 wherein said rotating means of said hub support is selected from the group consisting of an electric motor, a pneumatic motor, and a hydraulic motor.

5. The abrasive machine as set forth in claim 1 wherein said driving means for said support comprise additional means for adjusting, position of said support in the direction of its rotational axis.

6. The abrasive machine as set in claim 1 wherein said driving means for said support are mounted inside a housing.

7. The abrasive machine as set forth in claim 6 wherein said housing has an outer shape with geometry selected from the group consisting of a triangle, a rectangle, a hexagon and a circle.

8. The abrasive machine as set forth in claim 6 wherein said housings are provided in plurality and wherein each housing comprises a means for connecting to an adjacent housing such that the overall machine is formed as a combination of individual housings.

9. The abrasive machine as set forth in claim 1 wherein said rotational means for said support comprise electronic controls and interface means for controlling speed, direction of rotation and angular position independently or in coordination with other abrasive machines or executed under numerical algorithm.

10. The abrasive machine as set forth in claim 5 wherein said additional means for adjusting position of said support is configured to be controlled remotely.

11. A method for providing an abrasive machine in accordance to claim 1 suitable for deburring operations, the method comprising the steps of providing an abrasive tool in a form of a rotary abrasive brush with driving means for rotation of said rotary abrasive brush, mounting said rotary abrasive brush with said driving means on a rotatable support with axis of rotation generally perpendicular to the axis of rotation of said rotary abrasive brush and providing a housing holding driving means for rotation of said rotatable support and positioning of said rotary abrasive brush in direction of axis of rotation of said rotary abrasive brush and providing a work piece with relative movement against said brush.

12. The method of claim 11 wherein said driving means for said rotary abrasive brush and said rotatable support are provided with sensory means and electronic control means for operation of their respective speed of rotation, direction of rotation and relative position to the work piece, for instance angular or linear position.

13. The method of claim 11 wherein said housings are provided in plurality and are interconnected to form a mechanical structure.

14. The method of claim 12 wherein said electronic controls are configured to accept and provide for control of a plurality or a cluster of deburring units in a pre-programmed fashion, and/or by execution of a numerical algorithm and/or utilizing feedback from the said sensory means.

15. The abrasive machine as set forth in claim 1 wherein said abrasive tool is comprised of a rotatable hub with helical groove formed along its outer surface containing a continuous abrasive filament formed from abrasive tape comprising a plurality of tape abrasive straps extending outwards and having a continuous edge, said filament being inserted into said groove by its edge so that said edge is buckled inside said groove in a fashion prescribed by the position and the shape of notches or perforations provided in desired fashion close to said edge where the ends of said filament are secured against said hub and is irreplaceably mountable on said hub support.

* * * * *